US005647325A

United States Patent [19]

Axbrink et al.

[11] Patent Number: 5,647,325

[45] Date of Patent: Jul. 15, 1997

[54] FUEL INJECTION DEVICE FOR INTERNAL COMBUSTION ENGINES

[75] Inventors: Göran Axbrink, Björketorp; Nils-Olof Håkansson, Stenkullen, both of Sweden

[73] Assignee: AB Volvo, Gothenburg, Sweden

[21] Appl. No.: 532,728

[22] PCT Filed: Mar. 16, 1994

[86] PCT No.: PCT/SE94/00230

§ 371 Date: Sep. 18, 1995

§ 102(e) Date: Sep. 18, 1995

[87] PCT Pub. No.: WO94/21912

PCT Pub. Date: Sep. 29, 1994

[30] Foreign Application Priority Data

Mar. 17, 1993 [SE] Sweden ..... 9300882

[51] Int. Cl.[6] ..... F02M 37/04

[52] U.S. Cl. ..... 123/496; 123/507; 123/508

[58] Field of Search ..... 123/507, 508, 123/509, 496, 504

[56] References Cited

U.S. PATENT DOCUMENTS

| | | | |
|---|---|---|---|
| 2,220,949 | 11/1940 | Richards | 123/507 |
| 2,260,414 | 10/1941 | Thaheld | 123/504 |
| 3,913,548 | 10/1975 | Wilson | 123/496 |
| 4,567,872 | 2/1986 | Kaver | 123/508 |
| 4,602,604 | 7/1986 | Kaver | 123/508 |
| 4,917,068 | 4/1990 | Takahashi et al. . | |
| 4,944,275 | 7/1990 | Perr | 123/496 |

FOREIGN PATENT DOCUMENTS

| | | | |
|---|---|---|---|
| 9420747 | 9/1994 | European Pat. Off. | 123/507 |
| 9420748 | 9/1994 | European Pat. Off. | 123/507 |
| 9424421 | 10/1994 | European Pat. Off. | 123/508 |
| 810 558 | 8/1951 | Germany . | |
| 233 437 | 7/1944 | Switzerland . | |

*Primary Examiner*—Carl S. Miller

*Attorney, Agent, or Firm*—Young & Thompson

[57] ABSTRACT

A fuel injection device for internal combustion engines comprises a unit injector for each cylinder and a rocker arm driving the pump piston of each injector, the rocker arm consisting of a rigid portion and a spring portion mounted under tension to the rigid portion, the spring portion deflecting at a predetermined load to limit the increasing pressure as the injection volume increases.

12 Claims, 2 Drawing Sheets

FUEL INJECTION DEVICE FOR INTERNAL COMBUSTION ENGINES

The present invention relates to a fuel injection device for internal combustion engines, comprising a unit injector extending into each cylinder chamber and containing a pump piston as well as means driving said pump piston, comprising a rocker arm cooperating with the pump piston and mounted on a rocker arm shaft and a cam shaft with a cam for each rocker arm, said cam providing, via the rocker arm, pump strokes in the pump piston upon rotation of the cam shaft.

In fuel systems with unit injectors, the sprayer and fuel pump are integrated in a single unit. A pump piston driven by a cam and a rocker arm builds up, under the control of a relief valve, a pressure in a pump chamber in the sprayer, and when this pressure exceeds the start-to-discharge pressure of the jet, the injection begins. The injection pressure increases continuously until the injection is terminated by an electrically operated relief valve being opened and conducting the fuel to a return line, whereupon the pressure drops below the discharge pressure of the jet. The length of the injection period and thus the maximum injection pressure, are determined by the period of time (the number of degrees of rotation of the cam) during which the relief valve is closed.

It is a wellknown fact that insufficient dispersion of the fuel during injection into a diesel engine results in black exhaust smoke. It is also a known fact that the higher the injection pressure is; the more finely the fuel will be dispersed. At the same time, however, the pressure increase will increase the mechanical load on the components involved, thus placing greater demands on material and dimensions. In modern diesel engines with unit injectors, the injection pressure is usually limited to about 150 MPa, which is sufficient to prevent black smoke from combustion. The higher pressure of the last injected fuel helps the fuel injected initially at lower pressure to burn completely.

In recent years increasing attempts have been made to raise the power of existing engine models by modifying the injection system, so that a greater volume of fuel can be injected into the combustion chamber during the injection stroke of the piston. This can be achieved in a simple and easily controllable manner by simply increasing the length of the injection. The problem is, however, that the maximum injection pressure is increased as a direct result thereof. This is not, however, a specifically desired effect, since soot-free combustion is already achieved at 150 MPa and increasing the pressure to 200 MPa for example does not provide any improvements as regards combustion, but rather only results in sharply increased mechanical stresses.

In order to increase the injection volume in a simple manner without increasing the mechanical stresses, it would of course be possible to increase the flow-through area of the jet apertures, but then there would be insufficient pressure for soot-free combustion at low rpm and at partial load. Theoretically, this problem could be solved with a sprayer with variable aperture size, but this would hardly be possible to achieve in practice.

The purpose of the present invention is in general to achieve a fuel injection device of the type described by way of introduction which makes it practically possible to increase the length of the injection period from a given period without increasing the maximum injection pressure and to be able to achieve the desired pressure even under partial load and at low engine speed. In particular it is the purpose of the invention to achieve a construction which does not require supplementing existing fuel injection devices with more or less complicated control systems, but which could be achieved with simple mechanical means instead.

This is achieved according to the invention by virtue of the fact that the drive means are so arranged that they limit, by elastic deformation of at least one element thereof at a predetermined force, the speed of the pump piston stroke, whereby the injection pressure can be kept at least essentially constant during a final phase of the fuel injection.

The invention thus utilizes elastic deformation in the driving of the pump piston in such a manner that, during a certain sector of the cam cycle, there is no directly coupled rocker movement at that end of the rocker arm actuating the pump piston, so that the piston speed is limited to that required to provide the desired pressure.

In a preferred embodiment of the fuel injection system, the described elastic deformation is achieved in the rocker arm itself by making the rocker arm of a stiff rocker arm element and a resilient element pivotally mounted and tensioned therein. The stiff element supports a cam follower and the resilient element supports a pin connected to the pump piston. The tension force is selected so that the two elements function as a rigid unit up to the load at for example 150 MPa injection pressure and that the resilient element connected to the pump piston is deflected thereafter, thus limiting the velocity of the piston stroke during the latter portion of the injection period.

BRIEF DESCRIPTION OF THE DRAWINGS

The invention will be described in more detail with reference to examples shown in the accompanying drawings, where

In FIG. 1, 1 designates a portion of a cylinder block and 2 a portion of a cylinder head. Details such as intake and exhaust ducts with associated valves and other components lacking importance for illustrating the invention, have been eliminated for the sake of simplicity. The engine is a direct injection diesel and has a piston 3 with a depression 4, forming the combustion chamber. It has a fuel injection system with so-called unit injectors 5, i.e. injectors each having an integrated pump piston 10 (indicated schematically) driven by a cam 6 on a cam shaft 5 and a rocker arm 8 on a rocker arm shaft 9. Furthermore the injector has a relief valve (not shown) actuated by an electromagnet 11, which determines the starting time and the length of the injection period. When the relief valve is opened, fuel is conducted via a channel 12 to a return line 13.

Figure 3:
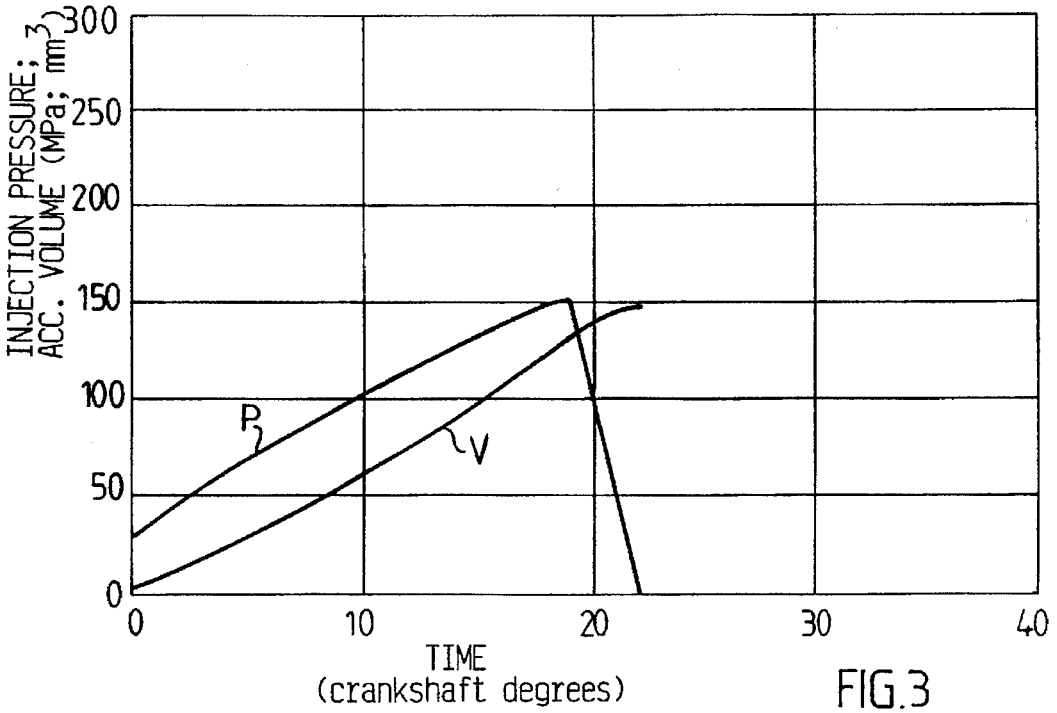
FIGS. 3 and 4 are diagrams showing injection pressure and injection volume as a function of the length of the injection period.

When the cam 6 depresses the piston via the rocker arm 8 and the set-screw 14 mounted on the rocker arm, said set-screw depressing a spindle 15 joined to the pump piston 10, the pressure rises in the sprayer, if the relief valve is closed. At a pressure over ca 30 MPa (the start-to-discharge pressure of the injection jet, see FIG. 3) the fuel injection begins. Under the influence of the cam 6, the injection pressure rises along the curve "p" in FIG. 3 at the same time as the fuel is injected. The curve "v" in FIG. 3 indicates the cumulative volume of injected fuel. After approximately 20 degrees of rotation, the relief valve is opened again and the pressure drops, terminating the injection. During the injection period, the pressure rises to a maximum 150 MPa, which is enough to disperse the fuel sufficiently to provide soot-free combustion. The cumulative injected volume is at that point about 150 $mm^3$.

Figure 4:
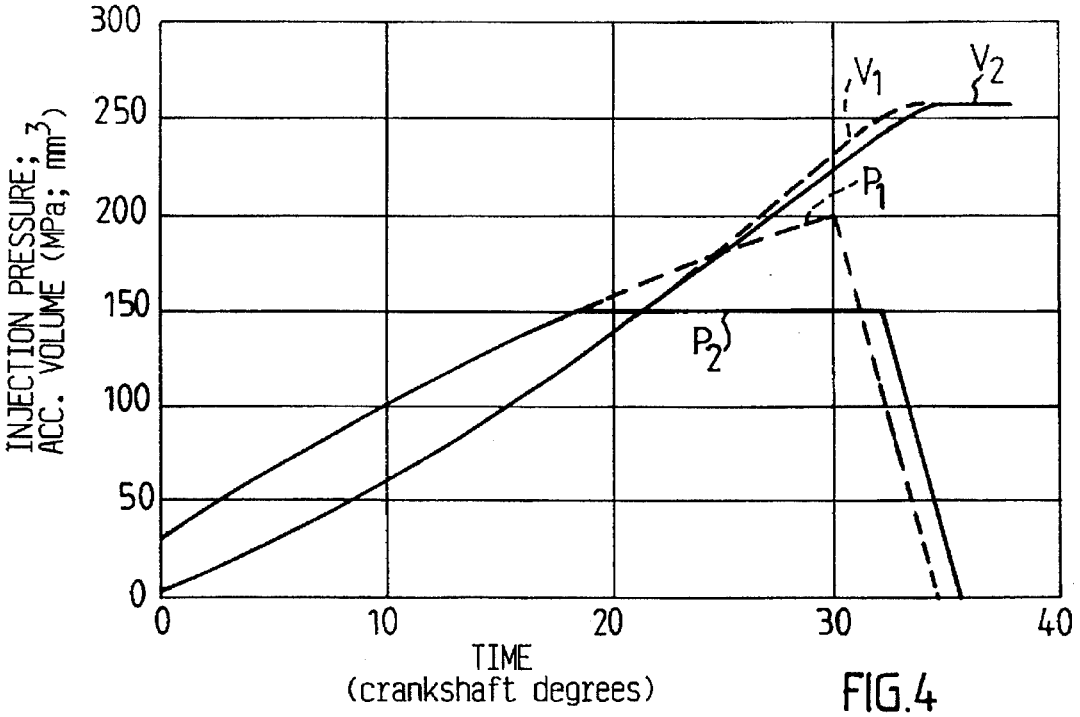

If one wishes to increase the injection volume to 250 $mm^3$, for example, in order to increase the power of the engine, this can be achieved by postponing the opening of the relief valve. In the diagram of FIG. 4, this is indicated by the dashed line "$v_1$". The relief valve is opened here after 30 degrees of rotation producing the injection pressure curve "$p_1$" shown with a dashed line. As is evident from the diagram, the maximum injection pressure is as much as 200 MPa, which sharply increases the load on the mechanical components. By making the rocker arm in accordance with the invention, as will be described below with reference to FIG. 2, the injection pressure curve can be flattened out so that a pressure of 150 MPa, for example, can be achieved at partial load and low rpm and be maintained during the latter phase of the injection up to full load, as is indicated by the solid line curve "$p_2$" in FIG. 4. The injection volume of 250 $mm^3$ is achieved here by extending the injection period by a couple of degrees of rotation over the curve "$p_1$", as is indicated with the solid line volume curve "$v_2$" in FIG. 4.

Figure 1:
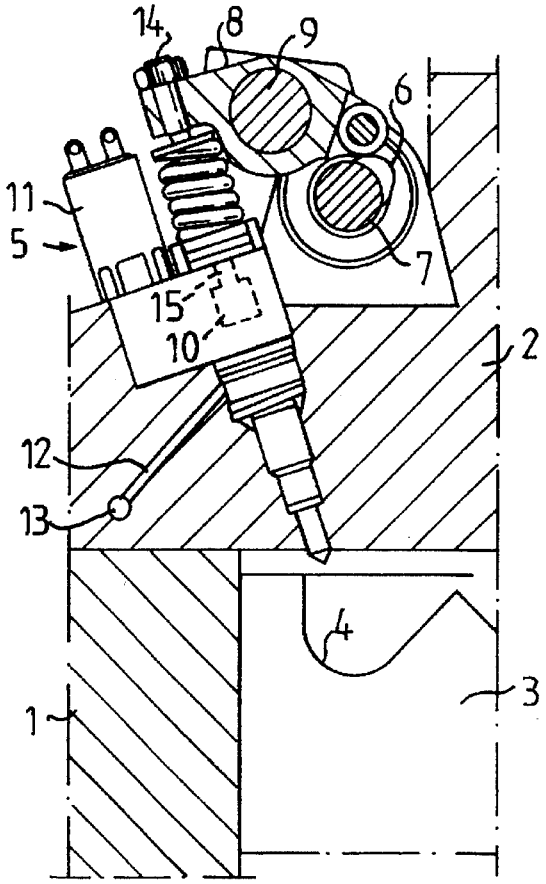
FIG. 1 shows a cross section through a portion of a schematically represented cylinder with associated portion of the cylinder head in a previously known diesel engine with unit injector.
Figure 2:
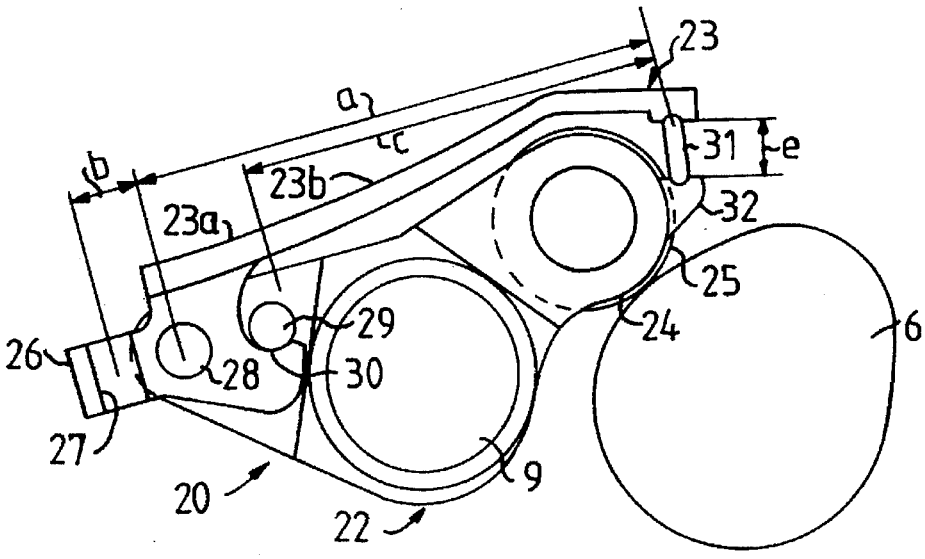
FIG. 2 shows a schematic sideview of a rocker arm in a preferred embodiment of the fuel injection device according to the invention.

FIG. 2 shows a rocker arm 20 intended to replace the rocker arm 8 in FIG. 1 and provide, together with the cam 6, the described flattened injection pressure curve "$p_2$" in FIG. 4.

The rocker arm 20 consists of two main components, i.e., on the one hand, a main rocker arm 22 which is rigid within its load range and, on the other hand, a resilient rocker arm 23. The rocker arm 22 has at one end portion 24 a cam follower in the form of a rotatably mounted roller 25. The resilient rocker arm 23 is divided into a portion 23*a*, which is rigid within its load range, and an elongated resilient portion 23*b*, i.e. the portion with less rigidity than the portion 23*a*, so that it can flex within an upper portion of its load range. The rigid portion 23*a* of the resilient rocker arm is provided with a short arm 26 with a threaded bore 27 for a set-screw 14 (see FIG. 1) and is pivoted to the rigid rocker arm 22 via a pivot pin 28.

The resilient rocker arm 23 is mounted under tension in the rocker arm 22 with the aid of a pin 29 interacting with a hook portion 30, and a spacer 31 which is pivotally mounted under tension between the distal end of the resilient rocker arm portion 23*b* and a shoulder 32 at the end of the rocker arm 22. The deformation during protensioning corresponds to the distance "e", which in practical embodiments is 8–20 mm and results in a pretensioning of about 2000N. This provides a completely rigid construction up to a load of about 13000N on the set-screw 14 at a mechanical advantage a/b 8/1 and a length "c" of the resilient portion 23*b* which is about 80% of the lever "a".

By using in the manner described a long spring under great tension provides great mechanical advantage and high precision. In the embodiment described here, an increasing load from 13000N to 15000N results in a deflection of the set-screw 14 of 0.15 mm, which is sufficient to give the flattening of the injection pressure curve "$p_2$" illustrated in FIG. 4.

The invention thus makes it possible to increase the power of an existing engine by increasing the volume of fuel injected without increasing the mechanical stresses subjected to the components of the fuel injection system at full load at the same time as it is possible to achieve such a high injection pressure even at low rpm and partial load that the generation of black smoke is sharply reduced.

What is claimed is:

1. In a fuel injection device for internal combustion engines, comprising a unit injector extending into each cylinder chamber and containing a pump piston as well as means driving said pump piston, comprising a rocker arm cooperating with the pump piston and mounted on a rocker arm shaft and a cam shaft with a cam for each rocker arm, said cam providing, via the rocker arm, pump strokes in the pump piston upon rotation of the cam shaft; the improvement wherein the drive means are so arranged that they limit, by elastic deformation of at least one element thereof at a predetermined force, the speed of the pump piston stroke, whereby the injection pressure can be kept at least essentially constant during a final phase of the fuel injection.

2. Device according to claim 1, wherein said element which is elastically deformed at a predetermined force, comprises a pretensioned resilient element.

3. Device according to claim 2, wherein the rocker arm comprises a rigid rocker arm element and a resilient element mounted under tension therein, and that these two elements have end portions directed in opposite directions, one of which interacts with the cam and the other with the pump piston.

4. Device according to claim 3, wherein the resilient element has, on the one hand, a short rigid portion forming said first end portion and being pivotally joined to the other end portion of the rigid rocker arm element and, on the other hand, an elongated less rigid portion which has a distal end mounted under tension against the first end portion of the rigid rocker arm element.

5. Device according to claim 4, wherein the distal end of the elongated less rigid portion is mounted under tension against the first end portion of the rigid rocker arm element by means of a tensioning means between the short rigid portion of the resilient element and the rigid rocker arm element.

6. Device according to claim 5, wherein the tensioning means is a pin extending through the rigid rocker arm element in its rocker axis direction and abuts against an abutment surface on the rigid portion of the resilient element.

7. Device according to claim 4, wherein the length of the rigid portion of the resilient element is a fraction of the less rigid portion thereof.

8. Device according to claim 4, wherein the length of the rigid portion of the resilient element amounts to at most 20% and at least 10% of the length of the less rigid portion.

9. Device according to claim 3, wherein the rigid rocker arm element at its first end portion supports a cam follower and that the resilient element, at its first end portion is provided with a threaded bore for a set-screw, which interacts with a spindle joined to the pump piston.

10. Device according to claim 4, wherein the less rigid portion of the resilient element has a cross-section which gradually diminishes towards its distal end.

11. Device according to claim 6, wherein the pin in the unloaded state of the rocker arm lies in an arcuate depression in the rigid portion of the resilient element.

12. Device according to claim 4, wherein the distal end of the less rigid portion is placed under tension against the rigid rocker arm element via a pivotally mounted spacer.

* * * * *